US009088857B2

(12) United States Patent
Tawada

(10) Patent No.: US 9,088,857 B2
(45) Date of Patent: Jul. 21, 2015

(54) AUDIO APPARATUS, CONTROL METHOD FOR THE AUDIO APPARATUS, AND STORAGE MEDIUM FOR DETERMINING SUDDEN NOISE

(75) Inventor: Noriaki Tawada, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 791 days.

(21) Appl. No.: 13/314,002

(22) Filed: Dec. 7, 2011

(65) Prior Publication Data

US 2012/0155662 A1 Jun. 21, 2012

(30) Foreign Application Priority Data

Dec. 15, 2010 (JP) ..... 2010-279894

(51) Int. Cl.
*H04R 29/00* (2006.01)
*H04S 7/00* (2006.01)
*H04S 3/00* (2006.01)

(52) U.S. Cl.
CPC . *H04S 7/301* (2013.01); *H04S 3/00* (2013.01); *H04S 7/307* (2013.01)

(58) Field of Classification Search
CPC ..... H04S 7/301
USPC ..... 381/58, 59
See application file for complete search history.

(56) References Cited

U.S. PATENT DOCUMENTS 7,333,618 B2 * 2/2008 Shuttleworth et al. ..... 381/57
2005/0270686 A1 12/2005 Kisaka

FOREIGN PATENT DOCUMENTS

JP 06-265400 A 9/1994
JP 2002-330500 A 11/2002
JP 2005-346815 A 12/2005
JP 2007-232492 A 9/2007

* cited by examiner

*Primary Examiner* — Duc Nguyen
*Assistant Examiner* — Kile Blair
(74) *Attorney, Agent, or Firm* — Canon U.S.A., Inc. IP Division

(57) ABSTRACT

An audio apparatus includes a sound generation unit configured to generate a measuring signal, a sound collection unit configured to obtain a sound collection signal, a detection unit configured to detect a level difference between the sound collection signal and background noise, a characteristic calculation unit configured to extract each signal period of the measuring signal from the sound collection signal, a feature amount calculation unit configured to calculate a feature amount representative of sudden noise for each period based on each of the period signals, and a determination unit configured to compare feature amounts of the periods and to remove, from periods to be used for averaging the period signals, a period or periods whose feature amounts are not within a range between a threshold value and a minimum value of the feature amounts as a reference, wherein the threshold value is determined according to the detected level difference.

12 Claims, 9 Drawing Sheets

AUDIO APPARATUS, CONTROL METHOD FOR THE AUDIO APPARATUS, AND STORAGE MEDIUM FOR DETERMINING SUDDEN NOISE

BACKGROUND OF THE INVENTION

1. Field of the Invention

The present invention relates to an audio apparatus for measuring acoustic characteristics.

2. Description of the Related Art

The impulse response between a sound generation source and sound receiving points in an acoustic space, such as a room or a hall, includes important information about acoustic characteristics of the acoustic space. The impulse response measured in a well-known hall, for example, can be stored in a storage unit of an audio apparatus. By performing filtering processing to convolve the impulse response signal into a signal of a musical piece to be played back, acoustic effects can be produced which will make a user feel as if the user were listening to music in the real hall. Similarly, when a microphone is placed at a listening point where the user sits in the room and measuring signals are emitted from speakers, a room impulse response between the listening point and the speakers can be measured. The measured room impulse response is used to generate a sound field correction filter. The sound field correction refers to processing for flattening the irregularity of amplitude-frequency characteristics of the impulse response caused by interference between direct sound and reflected sound in the room, particularly, flattening peaks and dips induced by low-frequency standing waves, which have considerable effects on the auditory sensation. In addition, a clear sound image can be obtained by performing delay compensation. The delay compensation makes coincident the rise start times regarding the impulse response between the respective speakers and the listening point.

As described above, it is useful to obtain the impulse response in various kinds of acoustic processing in the audio apparatus. In this respect, what counts is a technique to measure the impulse response with high accuracy, in other words, a technique to suppress the influence of noise on measurement of the impulse response.

When the impulse response is measured in a room, since there is intrinsic background noise in the room, the signal-to-noise ratio of a signal picked up by the microphone deteriorates. For this reason, Japanese Patent Application Laid-Open No. 2002-330500 discusses a technique which measures an environment noise level and determines a level of the measuring signal in order to secure a better signal-to-noise ratio in relation to the background noise.

It is a common practice to generate a measuring signal a plurality of times to obtain a single impulse response and perform synchronized addition (=signal averaging) of sound collection signals to cancel out the background noise to improve the signal-to-noise ratio.

Japanese Patent Application Laid-Open No. 2005-346815 discusses a method of removing irregular noise from burst signals of plural periods read by a read processing unit of the disk device. More specifically, integrated values of absolute values of period burst signals are compared and a predetermined number of periods counted from a maximum value and/or a minimum value are not used for subsequent processing. In this manner, noise is removed from the signals.

In measurement of the room impulse response, while a sound is being collected, besides steady background noise, such as a running air conditioner, unexpected sudden or transient noise is liable to occur, such as a ringing telephone, human voice, an opening or closing door, and a honking from a car outside. In audio apparatuses these days, multi-channel speakers have been adopted and the measuring points have increased due to the gradual expansion of a listening area for which the sound field correction is required. The required number of times of measurement of impulse response signals is on the increase. There is a high possibility that the sudden noise described above is mixed in the sound collection signal during measurement.

According to the method discussed in Japanese Patent Application Laid-Open No. 2002-330500, the sound-to-noise ratio relative to steady-state environment noise can be improved, but this method fails to offer countermeasures against the sudden noise. When a clipping of the sound collection signal is detected, if simple measures, such as re-measurement, are taken, only sudden noise of a very high level can be determined, and re-measurement takes additional time.

The method discussed in Japanese Patent Application Laid-Open No. 2005-346815 can be used to remove sudden noise from the sound collection signal. However, out of signals of plural periods, the number of unusable periods has already been set as a default value, and noise countermeasures do not take the status of a signal transmission system into consideration and can never be viable measures for noise reduction. Therefore, there is a possibility that usable periods not including noise are not used for subsequent processing and periods including noise are used for subsequent processing.

SUMMARY OF THE INVENTION

The present invention is directed to an audio apparatus capable of obtaining an impulse response with high accuracy by determining sudden noise in a sound collection signal while taking the status of an acoustic space into consideration when a room impulse response is measured.

According to an aspect of the present invention, an audio apparatus includes a sound generation unit configured to generate, as a sound generation signal, a measuring signal including a plurality of repeated signal periods, a sound collection unit configured to obtain a sound collection signal by collecting the sound generation signal having been emitted as sound waves in an acoustic space, a detection unit configured to detect a level difference between the sound collection signal and background noise, a characteristic calculation unit configured to extract each signal period of the measuring signal from the sound collection signal and to calculate a characteristic of an acoustic space based on an average of the extracted period signals and the measuring signal, a feature amount calculation unit configured to calculate a feature amount representative of sudden noise for each period based on each of the period signals, and a determination unit configured to compare feature amounts of the periods and to remove, from periods to be used for averaging the period signals, a period or periods whose feature amounts are not within a range between a threshold value and a minimum value of the feature amounts as a reference, wherein the threshold value in the determination unit is determined according to the level difference detected by the detection unit.

According to an exemplary embodiment of the present invention, in measurement of a room impulse response, sudden noise in a sound collection signal is determined according to a level difference between the sound collection signal and background noise, and a period or periods in which sudden noise is mixed are excluded from periods to be used for averaging measurement results. Therefore, a highly accurate impulse response can be obtained.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
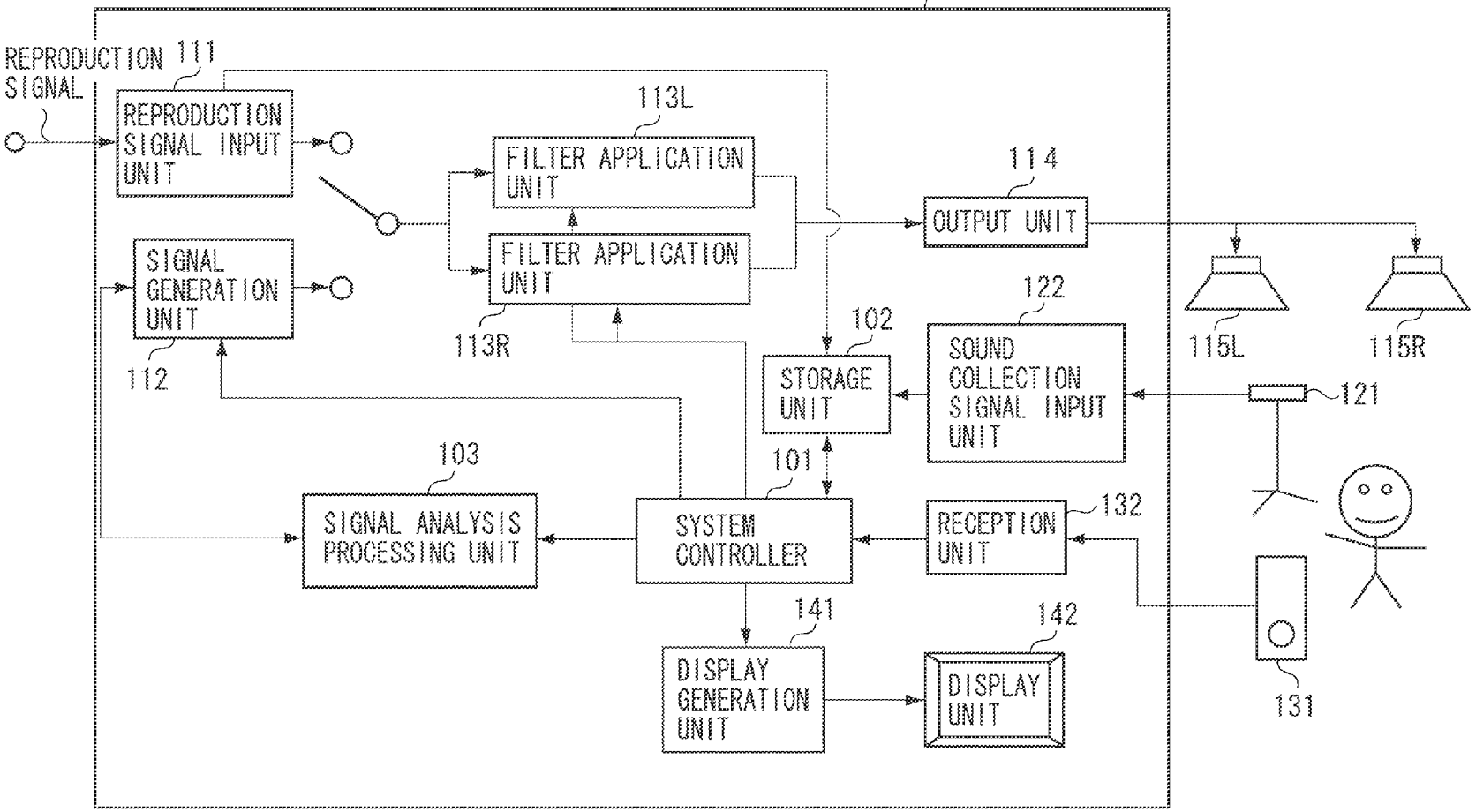
FIG. 1 is a block diagram of an audio apparatus according to a first exemplary embodiment of the present invention.

FIG. 1 is a block diagram of an audio apparatus according to a first exemplary embodiment of the present invention. The audio apparatus illustrated in FIG. 1 includes a main controller 100. The main controller 100 includes a system controller 101 configured to control the whole system, a storage unit 102 configured to store various data, and a signal analysis processing unit 103 configured to analyze signals. The audio apparatus further includes elements to implement functions of a reproducing system, such as a reproduction signal input unit 111, a signal generation unit 112, filter application units 113L and 113R, an output unit 114, and speakers 115L and 115R as sound generation sources. The audio apparatus further includes elements to implement functions of a sound collection system, such as a microphone 121 and a sound collection signal input unit 122. The audio apparatus yet further includes elements to receive commands from the user, such as a remote control unit 131, a reception unit 132, and elements to provide information for the user, such as a display generation unit 141 and a display unit 142. Data processing devices, including the signal analysis processing unit 103, the signal generation unit 112, the filter application units 113L and 113R, and the display generation unit 141 are connected to the storage unit 102 (wiring not illustrated).

The reproduction signal input unit 111 receives a reproduction signal from a sound source reproduction apparatus, such as a compact disc (CD) player, and if the signal is analog, the signal is subjected to A/D conversion before being sent to subsequent digital signal processing. As a signal sent to the filter application units 113L and 113R, the user selects which signal to send, a reproduction signal from the reproduction signal input unit 111 or a signal generated by the signal generation unit 112. The signal processed by the filter application units 113L and 113R is sent to the output unit 114, where the signal is passed through D/A conversion and is amplified, and then sound is emitted from the speakers 115L and 115R. When an active speaker is used, the output unit 114 and the speakers 115L and 115R are made to function in a single element. The sound collection signal input unit 122 receives a sound collection signal from the microphone 121, and is amplified and undergoes A/D conversion to be passed through subsequent digital signal processing. At this time, the microphone 121 and the remote control unit 131 may be unified into an input device. The display unit 142 need not necessarily be formed as a display panel and built in the main controller 100, but may be provided as an external display device.

Sudden noise reduction processing in measurement of a room impulse response will be described in a case where sound field correction is performed as a function of the audio apparatus.

The user issues a command to "Start sound field correction" to the controller 100 from the remote control unit 131. The command is received by the reception unit 132 and interpreted by the system controller 101. Then, information corresponding to the current status of a sound field correction sequence is generated by the display generation unit 141 and displayed on the display unit 142 for the user to see. In this case, the user sets the microphone 121 at a listening point where the user will listen to music, and in a state of readiness, the user presses the "OK" button of the remote control unit 131. This is all that the user is supposed to do beforehand.

Generally, a microphone with which measurement is performed is preferably at the height of the user's ears when the user sits (about 1 meter high). Particulars that are described here need not necessarily be listed on the display unit 142. Minimum information about the current status may be shown in a readily understandable manner, and a detailed description can be provided in a paper manual. Information or instructions for the user need not be given visually via the display generation unit 141 and the display unit 142. An audio version of the same information can be generated by the signal generation unit 112, and announced from the speakers 115L and 115R as an audio guide.

When the user sets the microphone 121 at the listening point and presses the "OK" button of the remote control unit 131, a message "Measurement for Measuring Point 1/L Will Take Place" is displayed on the display unit 142, which relates to measurement of an impulse response between the speaker 115L and the listening point. Hereafter, the sudden noise reduction processing will take place during measurement according to the flowchart shown in FIG. 2.

In step S201, the signal generation unit 112 generates a sound generation signal. A Maximum Length Sequence (MLS) or a Time-Stretched Pulse (TSP) is generally used as a command to measure characteristics of the room, or a room impulse response. Those measuring signals can be generated by using a simple mathematical formula. The signal generation unit 112 does not always need to generate a measuring signal on the spot, but a measuring signal may be stored in the storage unit 102 and has only to be read out when necessary. At this time, a single measuring signal is one period long and measuring signals of plural periods are connected into one measuring signal, which is emitted as a sound generation signal from the speaker 115L or 115R. In this way, a periodic measuring signal is obtained, formed by multiple consecutive signal periods having a repeating signal pattern. This processing is done to achieve an ordinary objective of performing signal averaging during sound collection to improve the sound-to-noise ratio in relation to the background noise. In addition, this processing is beneficial for sudden noise reduction in the present invention.

Figure 3:
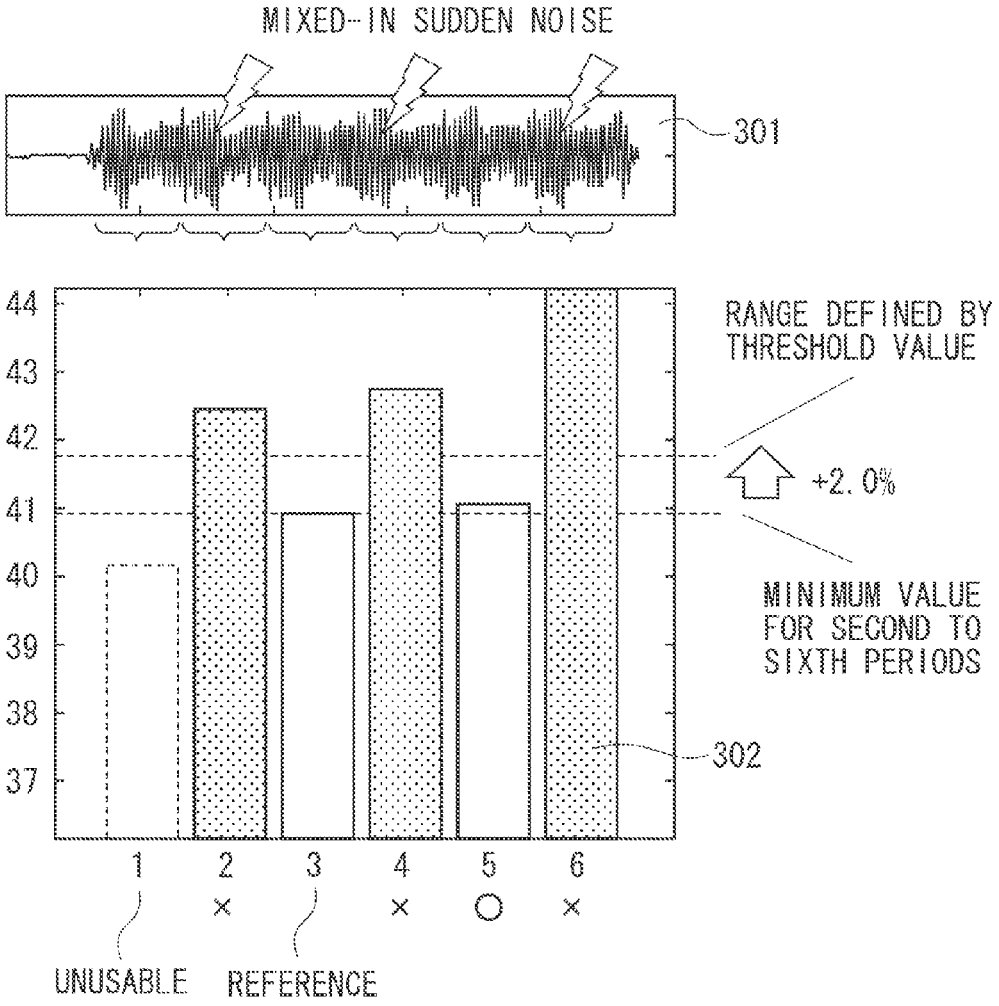
FIG. 3 is a diagram illustrating an example of determination of sudden noise.

In step 202, the system controller 101 emits a sound generation signal generated in step S201 and collects the emitted signal. In other words, out of the reproduction signal input unit 111 and the signal generation unit 112, the latter is selected, and out of two speakers 115L and 115R, only the speaker 115L as the current object in measurement emits the sound generation signal. The filter application units 113L and 113R need not process the sound generation signal, and the sound generation signal has only to pass through those filter units. The sound generation signal emitted as sound waves therefore enter a state that the room's effects, such as reflected or standing waves, are convolved with it, and is collected by the microphone 121, and stored as a sound collection signal in the storage unit 102. At this time, to enable obtaining background noise from the sound collection signal in step S206, the system controller 101 starts recording the sound collection signal a predetermined time T earlier than the start of sound generation. Alternatively, in step S201, a silent (no sound) time span for a predetermined time period T may be added to the head of the sound generation signal, which is generated in step S201, and sound emission and collection may be started simultaneously. If measuring signals of six periods are connected in step S201, a sound collection signal obtained in step S202 has a waveform as illustrated at 301 in FIG. 3. In the following description, the sound generation signal is formed by connecting measuring signals of six periods, but the present invention is not limited to this number of periods.

Figure 2:
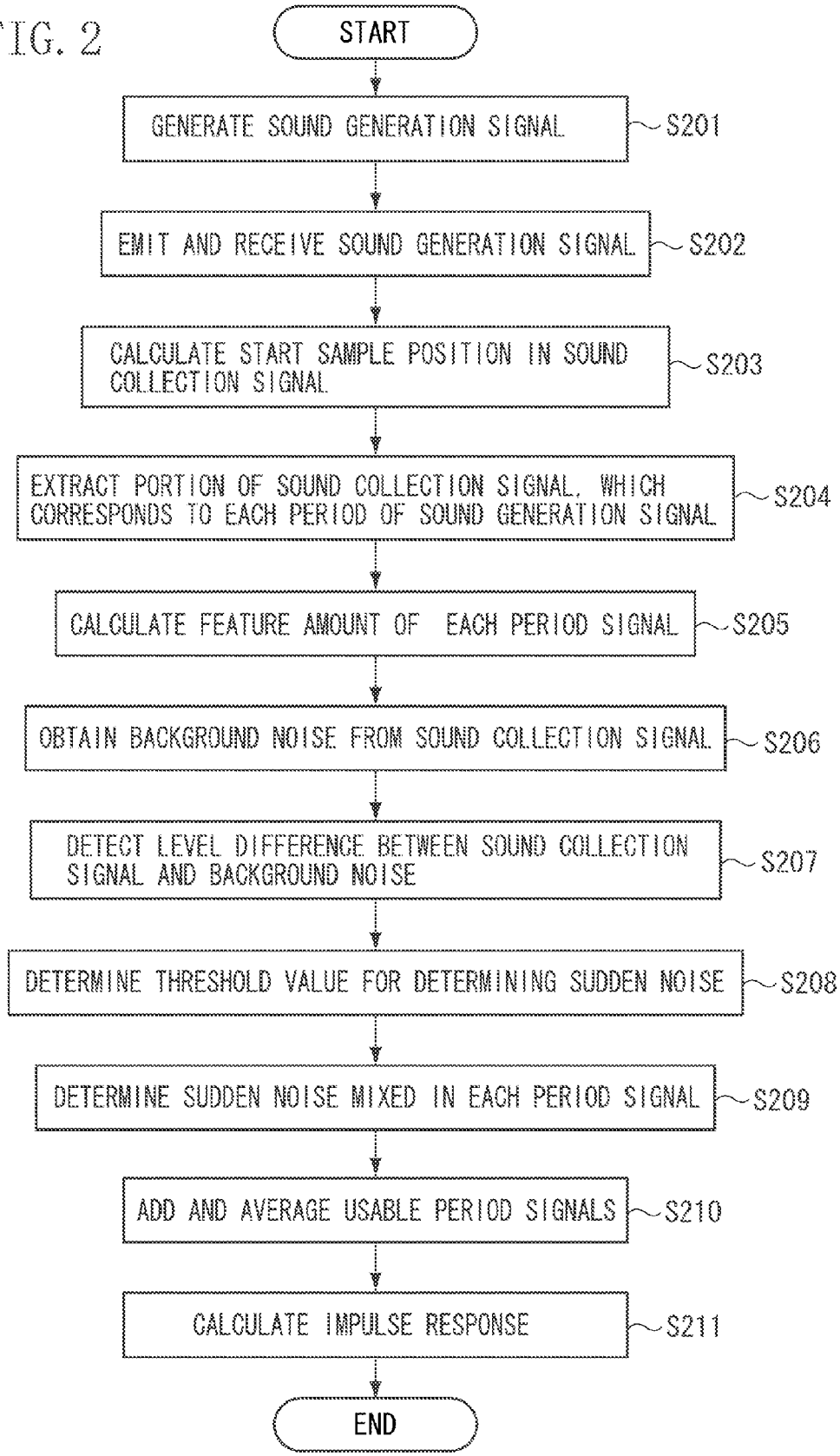
FIG. 2 is a flowchart illustrating processing against sudden noise in the first exemplary embodiment.

Processing from step S203 on in the flowchart of FIG. 2 is executed by cooperation between the signal analysis processing unit 103 and the storage unit 102.

In step S203, a start sample position B, at which appears a signal portion corresponding to the sound generation signal obtained in step S202, is calculated. More specifically, by using a sample corresponding to one period of a measuring signal and obtainable from an early portion of a sound generation signal, a cross correlation between the sample and the measuring signal is calculated. A measuring signal, such as an MLS signal or a TSP signal, has a property that auto correlation exhibits a dirac function or impulse when $\tau=0$. Therefore, to find a correlation between the measuring signal and the sound collection signal corresponds to autocorrelation of the measuring signal convolved with the transfer function (impulse response) and so corresponds to obtaining a room impulse response, and a peak position of the impulse response is considered as the start sample position B. Instead of from an early portion of the sound collection signal, if the sample is taken, for example, from a position corresponding to the predetermined time T described in step S202, a position reached by going back for a number of samples from the peak position is taken as the start sample position B. Cross correlation is generally calculated in frequency domain by fast Fourier transform (FFT), but if a measuring signal is an MLS signal, fast Hadamard transform (FHT) can be used. An impulse response obtained in this manner cannot be said to represent accurate room characteristics because an appropriate portion of the sound collection signal is not used. However, since peaks are clearly noticeable, this impulse response is used only to find the start sample position B.

In step S204, from the sound collection signal, sample signals corresponding to periods of the sound generation signal are extracted, starting with the start sample position B calculated in step S203. Signals of K-th (K=1 to 6) periods can be obtained by extracting samples $B+(K-1)\cdot L$ to $B+K\cdot L-1$ of the sound collection signal, where L is the number of period samples of the measuring signal.

A brief summary from step S205 on will be described below. Generally, if sudden noise is mixed while an impulse response is measured, a noticeable change is distortion in the amplitude-frequency characteristics of the obtained impulse response. However, a processing operation for calculating the amplitude-frequency characteristics based on the impulse response is required. Furthermore, an absolute criterion for determining whether sudden noise is mixed cannot be easily defined. Therefore, whether sudden noise is mixed is determined by calculating some feature amount, such as a bar graph 302 illustrated in FIG. 3. The bar graph is based on individual period signals obtained when sound is received, in other words, by taking advantage of a fact that the sound generation signal is formed by connecting measuring signals of several periods. However, the signal of the first period does not include reverberation components of the previous period, that is, the signal is different from signals of other periods. Therefore, this signal is not used in subsequent processing. In fact, in step S201, measuring signals of three or more periods are connected. In a relative comparison, too, since some threshold value is required in determining sudden noise, in the present exemplary embodiment, by using a threshold value obtained considering the status of background noise in the room, a mixture of sudden noise is determined with high accuracy. Signals of periods determined to have sudden noise mixed in are not used in computing of an impulse response, so that the accuracy of the impulse response can be improved.

In step S205, feature amounts of respective periods are calculated from signals of the periods obtained in step S204. Desirable conditions of the feature amounts are that the periods should exhibit almost the same value when sudden noise is not mixed and that the periods having sudden noise mixed exhibit values should vary widely. As a result of examination and experiment in which, actually, various types of sudden noise were generated, it has been clarified that a sum of absolute values or a sum of squares of the period signals, which can be obtained by simple calculation meet those conditions. The feature amounts were positive values and the feature amounts of the noise-mixed periods invariably increased in the range where the experiment was performed. This is considered to be because, although mixing of sudden noise may sometimes increase the amplitude of the measuring signal, it rarely cancels the measuring signal to decrease the amplitude thereof.

Since the sum of absolute values or the sum of squares of signals are feature amounts in a time domain, no viewpoints about frequency are included. However, the frequency range as an object of sound field correction is down to 20 Hz at lowest in the area below the limit of the low-frequency reproduction capability of the speaker. Therefore, even if less than 20 Hz of sudden noise is mixed and turbulence occurs in the impulse response amplitude-frequency characteristics, there is no problem because it is not in the frequency range as the object of sound field correction. From this point of view, a low-cut filter may be provided to cut frequencies less than 20 Hz for the period signals before feature amounts are calculated. Then, sudden noise less than 20 Hz may be disregarded. If a low-cut filter for low frequencies is implemented with an FIR filter, the taps tend to be long. If an IIR type filter or a second-order biquad filter for both the numerator and the denominator is used, low frequencies can be sufficiently cut by a simple processing configuration.

If a more severe restriction is to be imposed on frequencies, each period should be subjected to FFT processing and led to the frequency domain, and the area of the amplitude-frequency characteristics graph can be used as a feature amount. At this time, if importance is placed on large-level frequency components, each period signal may be scaled at an amplitude level, amplitude levels may be added over a range of the object frequencies, and the sum may be used as a feature amount.

If the object frequencies are restricted as described above, the periods which are determined to have noise mixed in will decrease for some frequencies of sudden noise. Therefore, by using an increased number of period signals for calculation of an impulse response, the impulse response can be obtained with improved accuracy of object frequencies.

In step S206, background noise is obtained from the sound collection signal recorded in step S202. At the leading end of the sound collection signal, in addition to the time difference for the predetermined time period T discussed in step S202, there appear small-amplitude areas due to a processing delay of the system and a delay in sound wave propagation corresponding to the distance between the speaker and the microphone. In the absence of the sound generation signal at least for the predetermined time period T, background noise can be obtained for a length of several samples corresponding to the predetermined time period T at the leading end of the sound collection signal.

In step S207, a level difference between the sound collection signal and background noise is detected. As for a level difference between signals, a ratio of sums of squares of signals is designated by E from a viewpoint of signal energy and a level difference is normally expressed by 10 log 10 (E) in decibel. Alternatively, if a ratio of sums of absolute values of signals is designated by A, a level difference is obtained by a similar value as 20 log 10(A). As a sound collection signal to calculate a level difference between the sound collection signal and the background noise, out of the second- to the sixth-period signals, a signal where the feature amount is a minimum, that is, a signal considered not to have sudden noise mixed in is used. At this time, because the number of background noise samples does not necessarily coincide with the number of samples of the measuring signals, a ratio of sums of squares or sums f absolute values of signals is formed by values from individual samples.

In step S208, a threshold value is determined which is used for determining sudden noise according to a feature amount of each period in a subsequent step S209. An overview of how a threshold value is treated is as follows. When sudden noise is not mixed, that is, when there is not any other noise but background noise, a threshold value is set to define a range including a feature amount of any occurring period. When this is done, a period whose feature amount is not included in the range defined by the threshold value can be determined as a period which has sudden noise mixed in.

Figure 4:
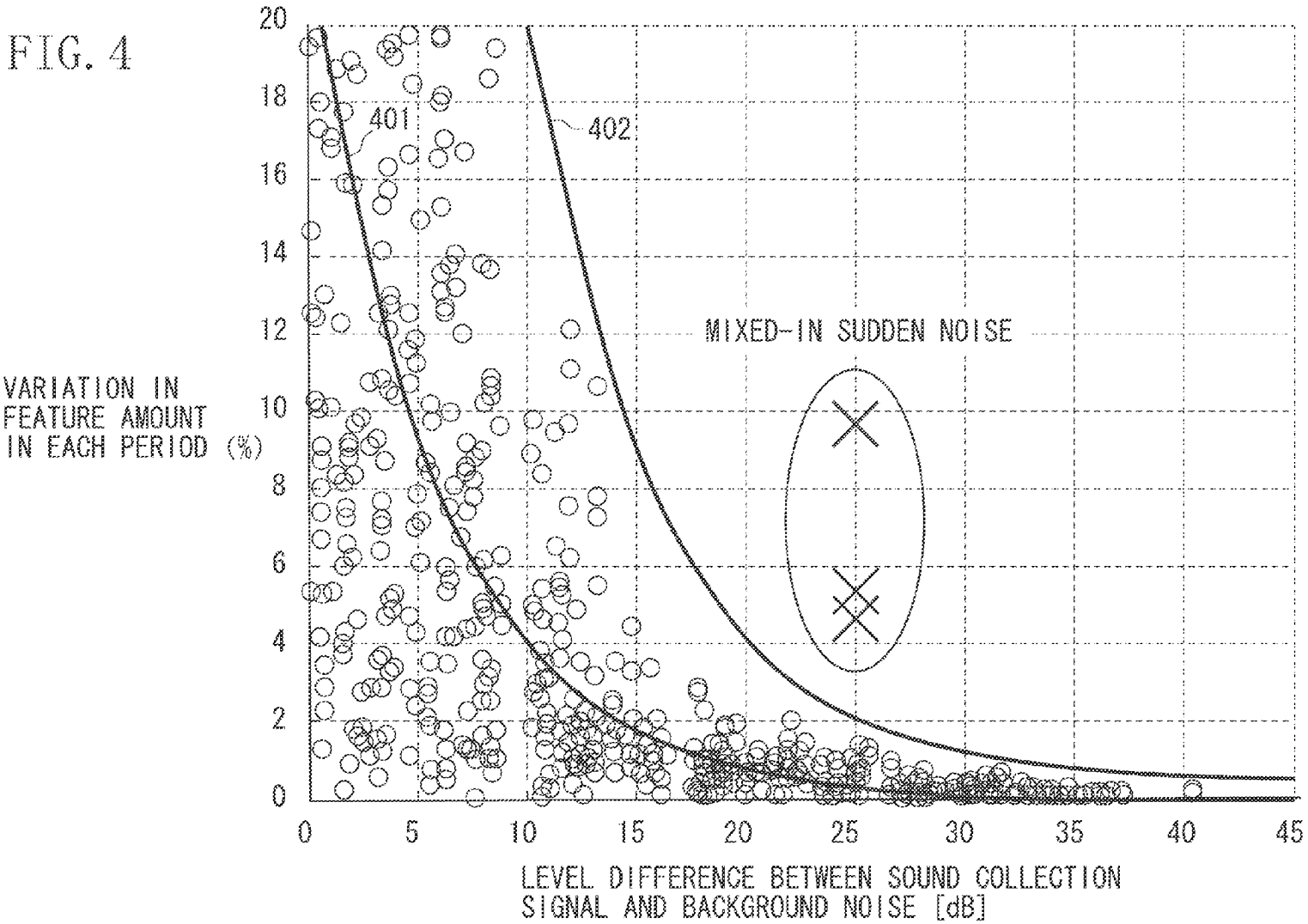
FIG. 4 is a diagram for explaining how to fix a threshold value for determining sudden noise.

Since the value of a feature amount for each period is calculated as a sum of absolute values or a sum of squares of signals, the feature amount depends a great deal upon the level of the sound collection signal. The feature amount is considered to change to some extent from one period to another due to the background noise present at all times independently of sudden noise. Therefore, in one embodiment the variation range of the feature amount from one period to another within a given measuring signal is expressed not by a difference between a maximum value and a minimum value, but by a minimum value+a % as a ratio relative to a value of a period having the minimum feature amount for that measuring signal as the reference. At this time, the larger the minimum value of the feature amount of each period as the denominator of the ratio is, the relatively smaller the variation due to background noise becomes. Let the vertical axis represent a variation a % of the feature amount of each period relative to a minimum value as the reference and let the horizontal axis represent the level difference between the sound collection signal and the background noise obtained in step S207. Then, the variation of the curve 401 decreases exponentially and converges as illustrated in FIG. 4. Note that the feature amount of the first period is not included in the feature amounts of the periods.

In a graph illustrated in FIG. 4, ring dots represent the above-described relation obtained as a result of measurement at various points in an actual room in the absence of sudden or transient noise. Besides the listening point as the common measuring point and many other points in the listening area, there are the measuring points in the vicinity of the speakers where the effect of direct sound is notable and the speaker characteristics are dominant. The sound is measured by the side of the walls and in the corners where the effect of the room structure manifests itself. In the room which was used, the sound absorbing characteristics differed greatly even between the opposite walls. Considering the circumstances, the dependence of the curve 401 on the room environment seems to be small.

The shape of the curve 401 will be studied briefly. In accordance with a method for calculating a feature amount, let a sum of absolute values or a sum of squares of background noise be designated by Nb and let a minimum value of a feature amount of each period be designated by Smin. Then, a ratio between a sound collection signal and background noise along the horizontal axis of the graph in FIG. 4 is expressed as x=Smin/Nb. If a feature amount of each period is designated by (Smin+Nb) and a variation of the feature amount is expressed as a ratio relative to Smin, the variation of the feature amount can be expressed as a curve y=(Smin+Nb)/Smin−1=Nb/Smin. Therefore, the relation of x and y is expressed by y=1/x, which is simple inverse proportion. As in the method for calculating a feature amount in step S205, the dependence of the shape of a curve on the type of measuring signal is considered to be low like the dependence on the above-mentioned room environment. In accordance with FIG. 4, if the horizontal axis represents the level difference (in dB) between the sound collection signal and background noise, the ratio between the sound collection signal and the ground noise can be expressed as x=20 log 10 (5 min/Nb), and the variation of the feature amount is expressed as $y=10^{(-X/20)}$ in an exponent function, which agrees with the shape of the curve 401.

On the basis of what has been described above, as a function of a level difference between the sound collection signal and the background noise, a threshold value curve 402 is determined so as to bound the variation range of the feature amount of each period. As illustrated in FIG. 4, the threshold value curve 402 has a shape as if the curve 401 is translated in positive directions of the vertical axis and the horizontal axis. For example, if the level difference between the sound collection signal and the background noise obtained in step S207 is 25 dB, the threshold value to find sudden noise is determined to be a minimum value+2% of the feature amount of each period signal according to the threshold value curve 402. The threshold value curve 402 may therefore be determined empirically, and be provided in a table form and stored in the storage unit 102, or may be calculated by a mathematical expression of an exponent function, for example.

In step S209, mixture of sudden noise in each period is determined by the feature amount of each period calculated in step S205 and by the threshold value obtained in step S208. In the example illustrated in FIG. 3, the determination is made by comparison with a reference value at the third period at which the feature amount is a minimum value out of the second to the sixth periods. The second, fourth and sixth periods have feature amounts higher than the minimum value plus 2% and therefore are determined to have sudden noise mixed in. When plotted on the graph in FIG. 4, those feature amounts are at points×enclosed by a circle. The threshold value is determined with high accuracy according to the difference between the level of the sound collection signal which varies with settings (generated sound level, positions of the measuring points, microphone gain, etc.) of the measuring system and the level of background noise of the room. Therefore, it becomes possible to accurately determine whether sudden noise is mixed.

In step S210, usable period signals are added and averaged, except for the periods determined in step S209 to have sudden noise mixed in and the first period. In the example illustrated in FIG. 3, by averaging signals of the third and the fifth periods, a resultant averaged signal with no sudden noise and reduced background noise is stored in the storage unit 102.

In step S211, the impulse response is calculated from the averaged signal obtained from the measuring signals and the averaged signal obtained in step S210. More specifically, a cross correlation of the measuring signals and the averaged signal is calculated just like in step S203. Only appropriate portions (periods) of the sound collection signal are used as signals to be added and averaged. Therefore, unlike in step S203, a room impulse response which accurately represents the room characteristics can be obtained. This impulse response is associated with the measuring point numbers (1=listening point) and also with sound generation patterns (L and R) of the speakers 115L and 115R, and is stored in the storage unit 102.

Figure 5:
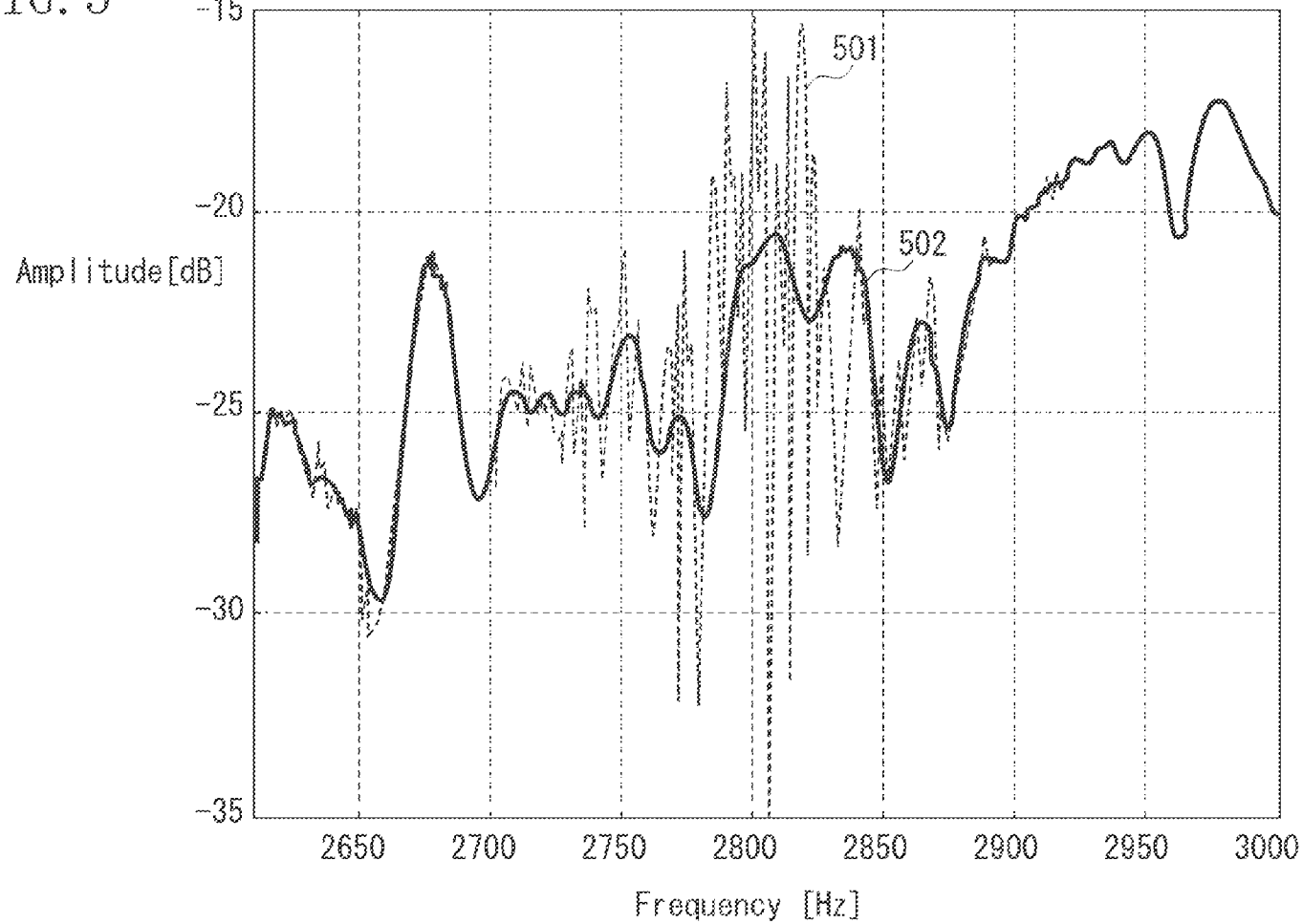
FIG. 5 illustrates an example of effects of a countermeasure against sudden noise.

FIG. 5 illustrates the effect of the present exemplary embodiment by illustrating amplitude-frequency characteristics of the impulse response. In FIG. 5, the fluctuating thin chain line 501 indicates the amplitude-frequency characteristics of the impulse response calculated from the averaged signal (corresponding to a 40-percent-trimmed average value) of the second to the sixth periods of the sound collection signal, except for two periods that exhibit a very large feature amount. This curve has less distortion than a case where a simple average of all of the second to the sixth periods is used (not illustrated). However, it is difficult to generate an accurate acoustic adjustment filter from the chain-line amplitude-frequency characteristics.

On the other hand, the solid line 502 in FIG. 5 indicates amplitude-frequency characteristics when sudden-noise reduction measures of the present exemplary embodiment are implemented. Amplitude-frequency characteristics free of turbulence can be obtained by determining and removing noise-mixed-in periods with high accuracy by using a threshold value in accordance with a level difference between the sound collection signal and the background noise. In this case, the averaged signal is obtained by excluding three periods that exceed the range defined by the threshold value because of large feature values and, it can be seen that the accuracy is higher than the chain-line amplitude-frequency characteristics in which the number of periods to be removed is determined in a rather noncommittal manner.

There is a possibility that sudden noise is mixed in the background noise portion obtained in step S206. However, this possibility seems to be relatively low because the background noise need not be captured to a length equal to the length of the measuring signals. Some measures may be taken based on a concept of sudden noise reduction described above. In other words, the background noise of a predetermined time period T may be divided into a plurality of time divisions, a feature amount of each time division may be calculated from a sum of absolute values or a sum of squares of time divisions. So, a time division where the feature amount is a minimum may be taken as background noise.

As described above, by following steps of the flowchart in FIG. 2, the impulse response between the speaker 115L and the listening point has been measured. Then, a message "Measurement for Measuring Point 1/R Will Take Place" is displayed on the display unit 142, which indicates measurement of an impulse response between the speaker 115R and the listening point. A sound generation signal is emitted only from the speaker 115R. Steps up to calculation of the impulse response are performed. In some specifications for sound field correction, in addition to measurement at the listening point, it is necessary to perform measurement at several points near the listening point, for example.

After measurement of impulse response signals at required measuring points is finished, the signal analysis processing unit 103 combines, by weighted combination, data of characteristics of the impulse response or, generally, data of amplitude-frequency characteristics stored in the storage unit 102. Then, the signal analysis processing unit 103 generates a sound field correction filter devised to correct the characteristics. The filter factors of sound field correction filter are stored in the storage unit 102, and a necessary filter factor is applied to a reproduction signal at the filter application units 113L and 113R in processing in a subsequent reproduction system, which is performed by selecting the reproduction signal input unit 111

As described above, in the present exemplary embodiment, an impulse response at high accuracy can be obtained by determining sudden noise in the sound collection signal by considering the status of the acoustic space in measurement of a room impulse response.

In the first exemplary embodiment, no particular restriction is provided for a level difference between the sound collection signal and the background noise obtained in step S207. However, as is apparent from FIG. 4, the smaller the level difference between the sound collection signal and the background noise is, the larger exponentially the variation of the feature amount of each period relative to a minimum value as the reference becomes, namely, the larger the irregularity of the feature amount of each period becomes.

Figure 6A:
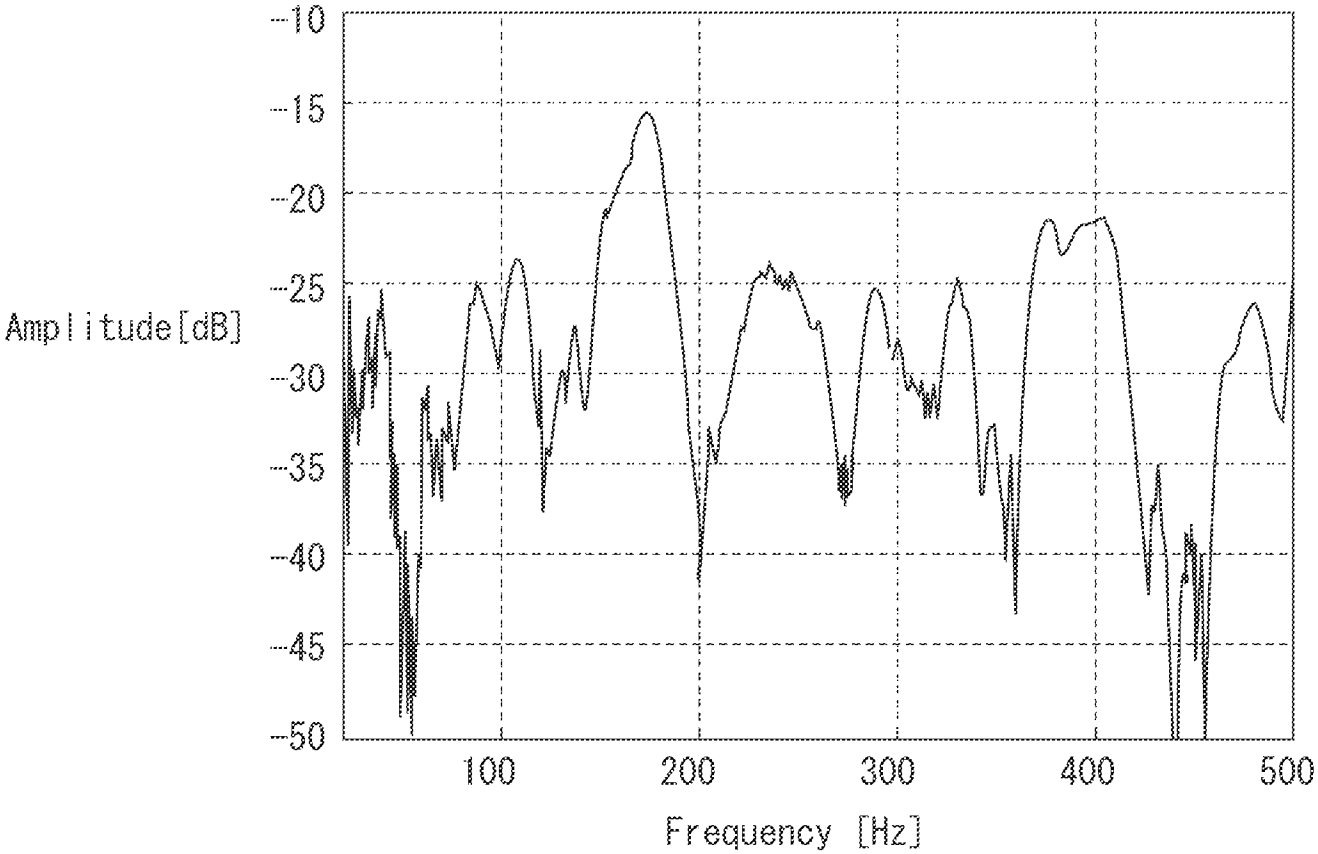
FIGS. 6A and 6B are diagrams illustrating necessity to adjust a sound generation level according to a second exemplary embodiment of the present invention.
Figure 6B:
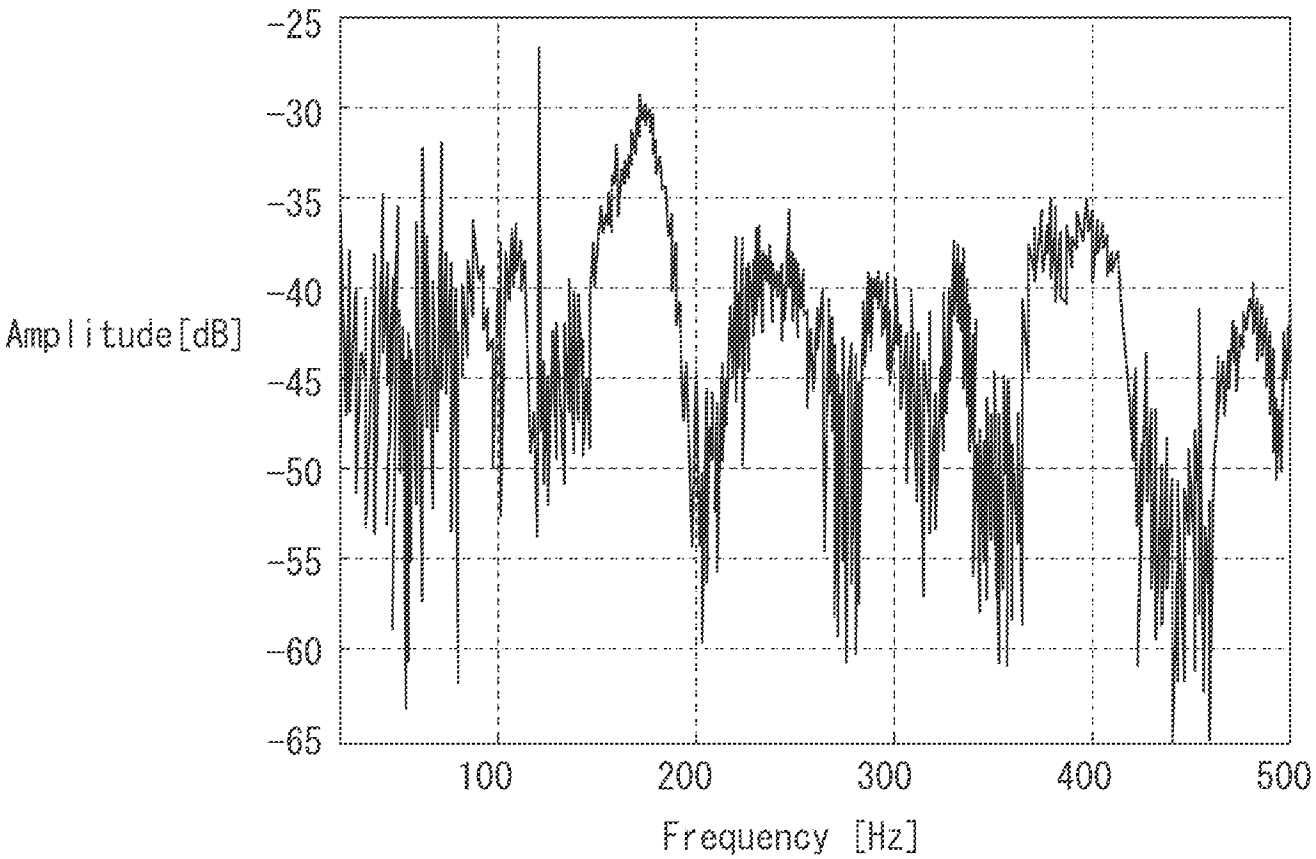

FIGS. 6A and 6B illustrate the amplitude-frequency characteristics of five impulse response signals superposed on each other, which are obtained from signals of the second to the sixth periods when sudden noise is not mixed in. FIG. 6A illustrates a case where the level difference between the sound collection signal and the background noise is about 22 dB. Since the irregularity of the feature amount of each period in FIG. 4 as a whole converges, the amplitude-frequency characteristics of the impulse response signals obtained from the period signals almost overlap each other. Therefore, even if the noise-mixed-in periods are excluded by the sudden noise reduction measures of the first exemplary embodiment and the number of periods usable for signal averaging in step S210 decreases, an impulse response exhibiting sufficiently accurate amplitude-frequency characteristics can be obtained.

FIG. 6B illustrates a case where the level difference between the sound collection signal and the background noise is no more than about 8 dB. This case can happen when the user has set the sound generation level at a low level or the room's background noise level is high or the room is spacious and the measuring points are far from the speakers. In this case, the feature amounts of the different periods vary widely, and the amplitude-frequency characteristics of the impulse response obtained from those periods differ greatly. In such a case, amplitude-frequency characteristics without turbulence cannot be obtained by signal averaging using a small set of numbers. Therefore, there is a possibility that it is difficult to satisfy both reduction of sudden noise and acquisition of a highly accurate impulse response.

In a second exemplary embodiment of the present invention, to begin with, a level difference between a sound collection signal and background noise is measured. Then, a check is made whether the level difference is within a predetermined range. If the level difference is outside of the range, the sound generation level is automatically adjusted to bring the level difference within the range, and the measurement is performed again. Basically, if the level difference does not reach the prescribed value, the sound generation level is adjusted to make the level difference reach the predetermined value. A lower limit of the predetermined range corresponding to the prescribed value is a level at which the threshold value curve 402 in FIG. 4 essentially converges or approaches an asymptote. The greater the number of periods of measuring signals used for sound generation becomes, the lower the prescribed value may be set taking signal averaging into account.

When the level difference between the sound collection signal and the background noise is larger than necessary, the sound generation level may be reduced. For example, if the sound generation level is too large, nonlinear errors of the speakers occur, and the accuracy of the obtained impulse response deteriorates. As preventive measures, an upper limit may be set to prevent nonlinear errors, and accordingly, an upper limit for the predetermined range may be set. In consideration of those measures, the sound generation level can be adjusted to bring the level difference between the sound collection signal and the background noise to the center of the predetermined range.

Re-measurement is performed from the beginning of the flowchart in FIG. 2. The adjustment of the sound generation level is added to step S201 and executed. The signal generation unit 112 scales an amplitude level of measuring signals or the system controller 101 is used to adjust an amplification gain in the output unit 114 (wiring not illustrated). Since both the sound generation level and the sound collection signal level are basically linear, the level difference between the sound collection signal and the background noise can be readily increased by 10 dB, for example. In re-measurement, the background noise need not be obtained again, and, therefore, step S206 can be omitted. Further, in step S202, sound collection need not be started before sound generation.

In the first exemplary embodiment, no specific restriction has been imposed on the number of periods to be added up and averaged in step S210. However, if there is no period in which a feature amount is within the range defined by a threshold value in the previous step S209, the only period that can be used in step S210 is the "reference" period whose feature amount is a minimum. Thus, it is impossible to perform signal averaging of a plurality of periods. In such a case as this, it is impossible to hope for improvement in the accuracy by signal averaging. Above all else, it is highly likely that sudden noise is mixed in entirety of the sound collection signal, including the period as the reference. Therefore, it is difficult to obtain an impulse response with high accuracy by subsequent stages of processing.

In a third exemplary embodiment of the present invention, if there is no period whose feature amount is within the range define by the threshold value in step S209, re-measurement is performed. The steps of the flowchart are executed from the initial step just like in the second exemplary embodiment. Since it is highly likely that sudden noise is mixed in the background-noise-picked portion of the sound collection signal, all steps including steps related to obtaining the background noise are to be executed without any omission of steps, during re-measurement, too.

In the first exemplary embodiment, the extraction start position in extraction of period signals from the sound collection signal in step S204 has been treated as the start sample position B calculated in step S203. However, in calculation of the impulse response in step S211, a cross correlation between the measuring signal and the adding-averaging signal is calculated using cyclic convolution as a premise. Therefore, the extraction start position need not necessarily coincide with the start sample position B, and a position B+C, which is shifted for a time equal to an optional number of samples C, may be an extraction start position. At this time, a rise of the impulse response occurs later than planned by a time equal to samples C. The samples C at the leading end are now shifted in a cyclic manner and brought to the end of a line of periods. If the amplitude-frequency characteristics of the impulse response have only to be made known to the user, the above operation need not be performed.

As described above, the extraction start position of the sound collection signal can be determined at the user's option. The sudden noise 701 (FIG. 7) that extends over two periods along the extraction start position can be put into one period by changing the original extraction start position. According to the above arrangement, the periods usable for signal averaging increase in number, and the accuracy of an impulse response can be improved. In the present exemplary embodiment, the extraction start position can be adjusted as follows.

In step S203, after a start sample position B in the sound collection signal is calculated, a number of samples (L) for a period of the measuring signal is divided by D, namely, $C \approx L/D$. The extraction start position is shifted at intervals of samples C. Steps of processing corresponding to steps 204 to 209 in the flowchart of FIG. 2 are executed repeatedly in a loop of extraction start position adjustment. In this manner, a better extraction start position is searched for. The steps descriptions of which are omitted are the same as the steps in the first exemplary embodiment.

Figure 7:
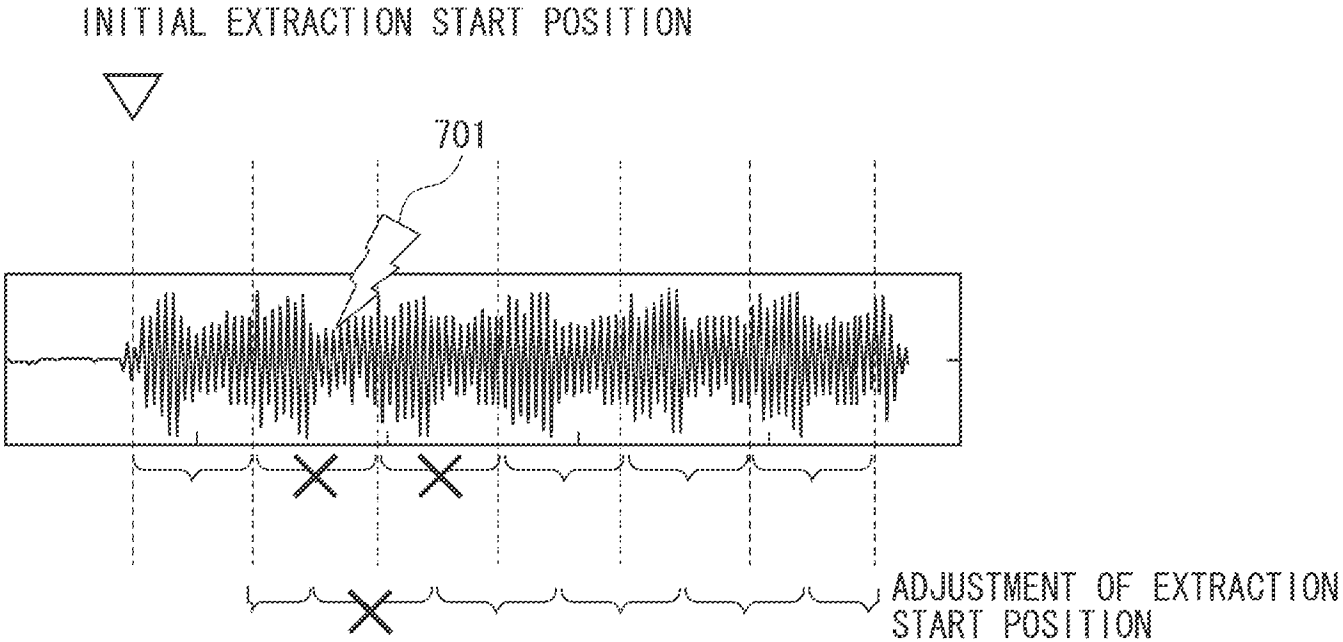
FIG. 7 is a diagram illustrating an advantage of adjusting a start position of extracting the sound collection signal in the second exemplary embodiment.

In step S204, period signals are extracted from the sound collection signal. Except for the first period (unusable) at the original extraction start position, the second to the sixth signal portions are extracted in a cyclic manner as indicated in FIG. 7. At J-th rounds (1 to D) of the loop, the extraction start positions are expressed as $B+L+(J-1)\cdot C$.

The background noise in step S206 has only to be obtained at the first round of the loop of extraction start position adjustment.

In step S209, after the mixture of sudden noise in each period is determined, the number of periods usable for signal averaging and an average value E of the feature amounts of usable periods are recorded. At the end of the D-th round loop, the numbers of usable periods for the extraction start position of each loop are compared with each other, and the extraction start position at which a largest number of usable periods is available is selected. If there are two or more extraction start positions at which the largest number of usable periods is available, the extraction start position at which the value E is a minimum is adopted. The value E used as a second-stage evaluation index may be an average value of variations of feature amounts of usable periods.

After the operations up to step S209 are finished by using an adopted extraction start position, by executing step S210 and so on, an impulse response with high accuracy can be obtained.

According to the above-described exemplary embodiments of the present invention, sudden noise in the sound collection signal can be determined and removed with high accuracy, and a highly-accurate impulse response can be obtained.

The main controller 100 indicated in FIG. 1 has been described in the first exemplary embodiment as formed by hardware, but processing executed in the main controller 100 may be implemented by a computer program.

Figure 8:
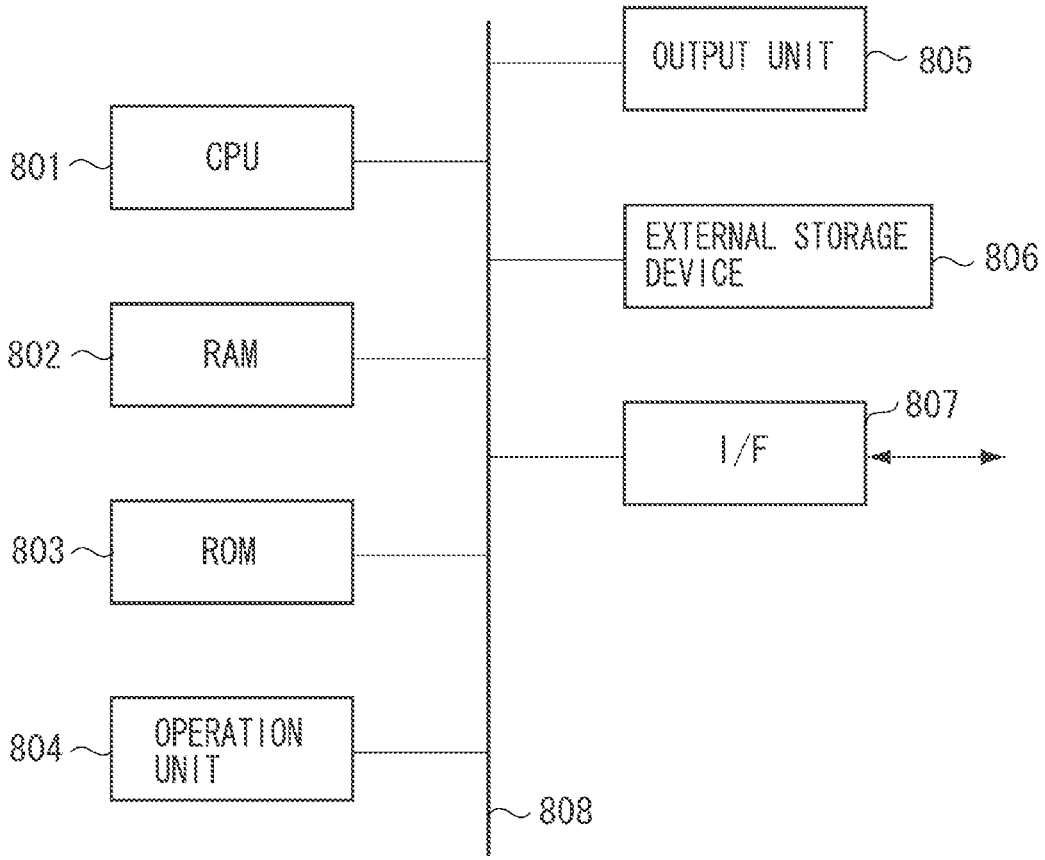
FIG. 8 is a diagram illustrating an example of a hardware configuration of a computer applicable to exemplary embodiments of the present invention.

FIG. 8 is a block diagram illustrating a structural example of computer hardware applicable to the audio apparatus according to the exemplary embodiments described above.

A CPU 801 controls the whole computer by using computer programs and data stored in a RAM 802 and a ROM 803. The CPU also executes the above-described items of processing in the audio apparatus according to the exemplary embodiments. The CPU 801 executes the functions in the above-mentioned exemplary embodiments and also functions as the main controller 100 in FIG. 1.

The RAM 802 has an area to temporarily store computer programs and data loaded from an external storage device 806, and also data obtained from outside via an interface (I/F) 807. The RAM 802 has an area which the CPU 801 uses when the CPU 801 executes various types of processing. The RAM 802 can be used as a frame memory and can provide its areas for other uses when necessary.

The ROM 803 stores setting data of the computer in FIG. 8 and a boot program and so on. An operation unit 804 includes a keyboard and a mouse, and is used by the user of this computer to input various commands to the CPU 801. A display unit 805 displays a result of processing executed by the CPU 801. The display unit 805 may be formed by a hold type display device, such as a liquid crystal display, for example, or an impulse type display device, such as a field emission type display device.

The external storage device 806 is a large-capacity storage device, such as a hard disk drive device. The external storage device 806 stores an operating system (OS) and computer programs used to make the CPU 801 to implement various functions illustrated in FIG. 1. The external storage device 806 may store various data as objects of processing.

The computer programs and data stored in the external storage device are loaded to the RAM 802 when necessary under control of the CPU 801, and executed by the CPU 801. The interface (I/F) 807 is used to connect to a network, such as a local area network (LAN) or the Internet, or to other devices. This computer in FIG. 8 can obtain and transmit various items of information via the I/F 807. A bus 808 is used to interconnect the units described above.

The operations included in the configuration discussed above and the operations described referring to the flowchart are performed chiefly under control of the CPU 801.

The present invention can be achieved by a system supplied with a storage medium containing computer program code that implements the above-mentioned functions when the system reads and executes the computer program code. In this case, the functions of the above-described exemplary embodiments are implemented by the code of a computer program read from the storage medium, and the storage medium storing the computer program code constitutes the present invention. The present invention also covers a case where an operating system (OS) running on the computer based on commands of the code of the computer program performs part or all of the actual processing, and by this processing, the above-mentioned functions are realized.

The present invention can be realized in the manner described below. The computer program code read from the storage medium is written in a memory provided in a function expansion card inserted in the computer or in a function expansion unit connected to the computer. Then, the above-mentioned described functions are implemented, for example, by carrying out part or all of the actual processing by a CPU mounted in the function expansion card or the function expansion unit according to commands of the computer program code.

When the present invention is applied to the above-mentioned storage medium, the storage medium stores the code of computer program corresponding to the flowchart described above.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-279894 filed Dec. 15, 2010, which is hereby incorporated by reference herein in its entirety.

What is claimed is:

1. An audio apparatus comprising:

a sound generation unit configured to generate, as a sound generation signal, a measuring signal including a plurality of repeated signal periods;

a sound collection unit configured to obtain a sound collection signal by collecting the sound generation signal having been emitted as sound waves in an acoustic space;

a detection unit configured to detect a level difference between the sound collection signal and background noise;

a characteristic calculation unit configured to extract a respective period signal from each signal period of the measuring signal from the sound collection signal and to calculate a characteristic of an acoustic space based on an average of the extracted period signals and the measuring signal;

a feature amount calculation unit configured to calculate a feature amount representative of sudden noise for each period based on each of the period signals; and a determination unit configured to compare feature amounts of the periods and to remove, from periods to be used for averaging the period signals, a period or periods whose feature amounts are not within a range between a threshold value and a minimum value of the feature amounts as a reference, wherein the threshold value in the determination unit is determined according to the level difference detected by the detection unit.

2. The audio apparatus according to claim 1, wherein the feature amount calculation unit calculates a sum of absolute values of the period signals as the feature amount of each period.

3. The audio apparatus according to claim 1, wherein the feature amount calculation unit calculates a sum of squares of the period signals as the feature amount of each period.

4. The audio apparatus according to claim 2, wherein the feature amount calculation unit calculates the feature amount of each period by detecting only a specific frequency component from each period signal.

5. The audio apparatus according to claim 1, wherein the feature amount calculation unit obtains a frequency characteristic of each period signal and calculates the feature amount of each period based on an amplitude of a specific frequency component of the frequency characteristic.

6. The audio apparatus according to claim 1, wherein, in a case where the level difference detected by the detection unit is not within a predetermined range, the determination unit is configured to perform re-measurement while adjusting a sound generation level of the sound generation unit to cause the level difference to be within the predetermined range.

7. The audio apparatus according to claim 1, wherein, in a case where there is no period included within the range defined by the threshold value and the minimum value of the feature amounts, the determination unit is configured to perform re-measurement.

8. The audio apparatus according to claim 1, wherein the characteristic calculation unit adjusts a start position of extracting each period signal from the sound collection signal and extracts each period signal in a cyclic manner to determine the start position most suitable for calculation of the characteristic.

9. The audio apparatus according to claim 1, wherein the detection unit detects a background noise level based on the sound collection signal.

10. The audio apparatus according to claim 1, wherein the threshold value corresponds to a ratio relative to a minimum reference value.

11. A non-transitory computer-readable medium storing a program which, when executed by a computer, causes the computer to function as the audio apparatus according to claim 1.

12. A method of determining a characteristic of an acoustic space, the method comprising:

generating, as a sound generation signal, a periodic measuring signal, comprising a series of repeated signal portions in each period, for emitting as sound waves in an acoustic space;

obtaining a sound collection signal by collecting, from the acoustic space, the sound generation signal;

determining a level difference between the sound collection signal and steady background noise of the acoustic space;

determining, for periods of the sound collection signal corresponding to periods of the measuring signal, a feature amount representative of sudden noise;

determining a threshold for the measure of sudden noise, based on the level difference;

selecting periods of the sound collection signal for which the measure of sudden noise is less than the threshold; and using the selected periods to determine the impulse response of the acoustic space.

* * * * *